US005203964A

United States Patent [19]

Call

[11] Patent Number: 5,203,964

[45] Date of Patent: Apr. 20, 1993

[54] PROCESS FOR PRODUCING CELLULOSE FROM LIGNIN CONTAINING RAW MATERIALS USING AN ENZYME OR MICROORGANISM WHILE MONITORING AND MAINTAINING THE REDOX POTENTIAL

[76] Inventor: Hans-Peter Call, Heinsberger Strasse 14A, D-5132 Ubach-Palenberg, Fed. Rep. of Germany

[21] Appl. No.: 815,896

[22] Filed: Dec. 31, 1991

Related U.S. Application Data

[63] Continuation of Ser. No. 701,574, May 14, 1991, abandoned, which is a continuation of Ser. No. 364,422, May 25, 1989, filed as PCT/EP87/00635, Oct. 24, 1987, abandoned.

[30] Foreign Application Priority Data

Oct. 24, 1986 [DE] Fed. Rep. of Germany ..... 3636208

[51] Int. Cl.[5] ..... D21C 3/20; D21C 7/12

[52] U.S. Cl. ..... 162/49; 162/62; 162/72; 435/278

[58] Field of Search ..... 162/1, 61, 62, 72, 49, 162/78, 65; 435/264, 274, 277, 276, 278

[56] References Cited

U.S. PATENT DOCUMENTS 3,041,246 6/1962 Bolaski et al. ..... 162/157.6

4,687,741 8/1987 Farrel et al. ..... 162/72

FOREIGN PATENT DOCUMENTS 54-68402 6/1979 Japan ..... 162/72

0654716 3/1979 U.S.S.R. ..... 162/49

OTHER PUBLICATIONS

ABIPC, No. 8566: Eriksson et al "Regulation of Lignin Degradation in Phanerochaete Chysosporium" Jun. 16–19, 1986.

*Primary Examiner*—Steve Alvo

*Attorney, Agent, or Firm*—Anderson Kill Olick & Oshinsky

[57] ABSTRACT

A process and an apparatus capable of removing and/or transforming lignin or its degradation products present in material containing lignocellulose. In the present process, a redox potential is set between 200 and 500 mV by the addition to an acid aqueous solution, which contains lignitic raw materials, of oxidizing agents and/or reducing agents and/or salts and/or phenolic compounds. The lignin degrading reaction and its attendant simultaneous bleaching effect is initiated by the addition of enzymes, microorganisms, animal or plant cells. Continuous stirring allows the reaction to be maintained for several hours at a value that fluctuates about a constant redox potential value, and a constant temperature.

18 Claims, 1 Drawing Sheet

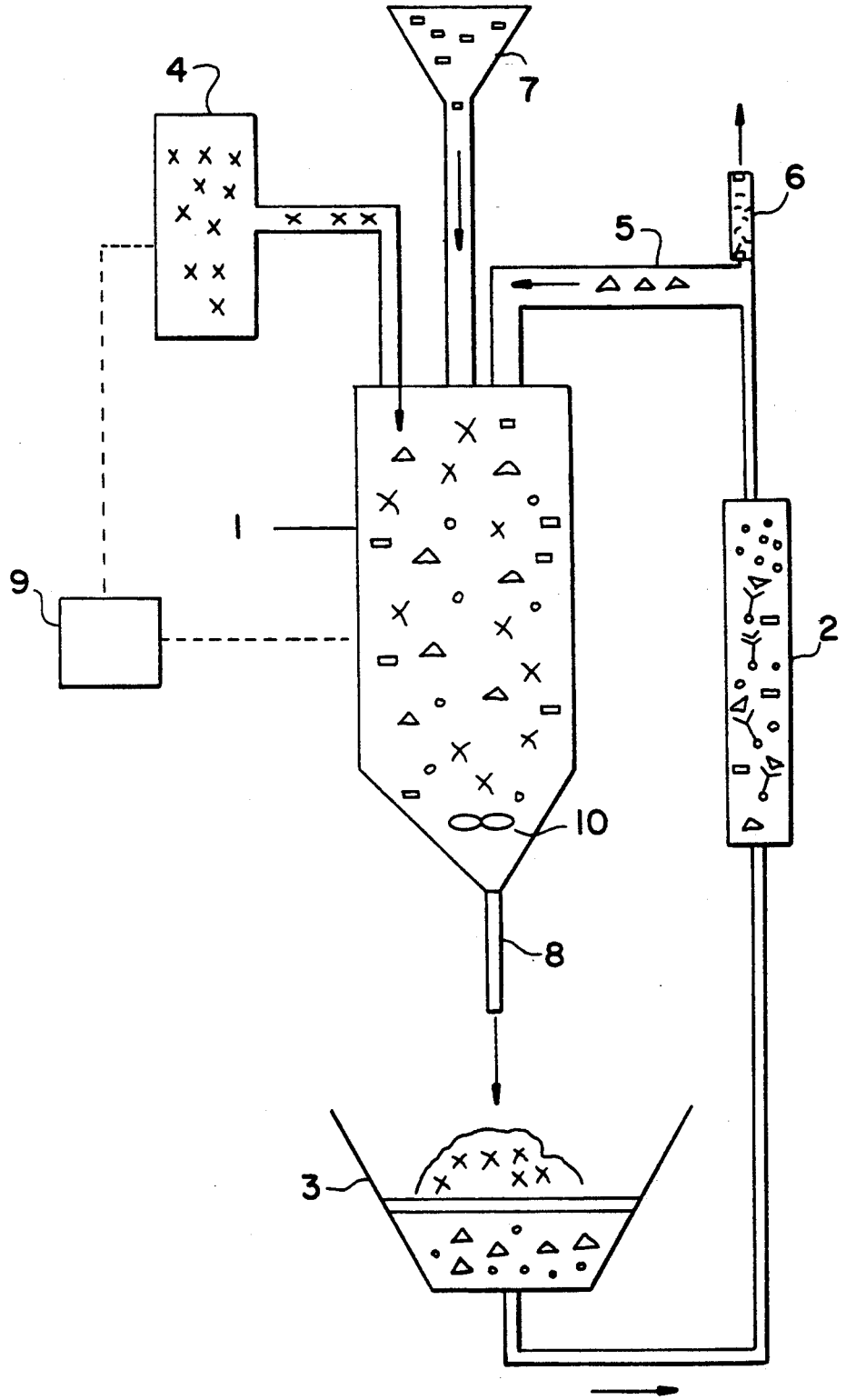
4
7
6
5
1
9
2
10
8
3

PROCESS FOR PRODUCING CELLULOSE FROM LIGNIN CONTAINING RAW MATERIALS USING AN ENZYME OR MICROORGANISM WHILE MONITORING AND MAINTAINING THE REDOX POTENTIAL

This is a continuation of application Ser. No. 07/701,574, filed May 14, 1991, now abandoned, which is a continuation of application Ser. No. 07/364,422 filed May 25, 1989, now abandoned, which was a continuation of PCT Application No. PCT/EP87/00635 filed Oct. 24, 1987, now abandoned.

The present invention relates to a process and a plant capable of removing and/or transforming lignin present in lignocellulosic material.

The production of cellulose or of cellulosic material requires that lignin be removed from the lignocellulosic material such as wood or annual plant matter. While removal processes significantly improve the mechanical and physical-chemical properties of paper produced from cellulose, the conventional methods used require high pressures and temperatures and employ environmentally harmful chemicals.

Prior art biological processes employed in cellulose production use microorganisms, especially fungi. A process used to recover cellulose from wood or other plant fibre materials, which in the lignocellulose is degraded with the aid of wood rot fungi, is known from the German patent specification 3110117. Methods employing microorganisms have, however, great disadvantages. It has not been possible, until the present time, to achieve the degradation and separation of lignin from its accompanying polymers (cellulose) without inciting the simultaneous growth of the microorganisms involved. Very long degradation times, up to several weeks in length, can result from such simultaneous growth.

In recent years, the possibility of employing isolated enzyme systems has been actively investigated in response to problems arising from the use of microorganisms. The enzymes of wood rot fungi, of which *Phanerochaete chrysosporium* is a particular example, were investigated and their role identified. Known, for instance, from "Biotechnology for the Pulp and Paper Industry 1986" is that, during the degradation of lignin in the absence of suitable enzyme systems, the equilibrium of the reaction shifts towards the polymer. It is also known from "Paszczgnski, A. et al: Comparison of Ligninasee-1 and Peridoxase-$M_2$ from the White-Rot Fungus *Phanerochaeta chrysosporium*. Arch. Biochem. Biophys. Vol. 244 No. 2" that the Mn-dependent peroxidase of *Phanerochaeta chrysosporium* is inhibited by reducing agents. By contrast, dithionite acts as an activator.

The object of the present invention is a process and a plant suitable for the removal and/or transformation of lignin present in material containing lignocellulose and wherein the above-mentioned disadvantages arising from the use of microorganisms, enzymes and chemicals, are eliminated. This object is accomplished by the addition of one or a plurality of oxidizing and/or reducing agents and/or phenolic compounds to an acid aqueous solution containing lignin raw materials in such a manner that a redox potential can be set between 200 and 500 mV. A lignin degradation reaction accompanied by a simultaneous bleaching process is subsequently initiated by the addition of enzymes, microorganisms, animal or plant cells. Continuous stirring maintains the reaction for several hours at a value that fluctuates about a constant redox potential value, constant temperature, and constant pH.

The preferred redox potential lies between 250 and 350 mV. In accordance with the proposed process, such a redox potential can be reached with the help of a redox electrode and then, with the aid of a regulator and adjustment mechanism, maintained at a constant value throughout the reaction period by the addition of oxidizing and/or reducing agents and/or salts and/or phenolic compounds and/or organic acids. Used preferably as oxidizing agents are hydrogen peroxide, oxygen and ozone; used as reducing agents are ascorbic acid, dithionite and sodium bisulfite. Suitable salts are $MnSO_4$ and/or $FeCl_2$. Veratryl alcohol can serve as the phenolic compound. Lactic acid can, for example, be employed as the organic acid.

In accordance with the proposed process, ligneous enzymes are preferred. Examples of such preferable enzymes are phenol oxidase, lallases and peroxides. The effectiveness of the proposed process can be increased by the addition of pectinase and/or hemicellulase.

In accordance with the proposed process, enzymes derived from the wood rot fungi, *Phanerochaete chrysosporium*, can be used. The latter may, if required, be employed in the degradation process.

The pH value lies, in accordance with the proposed process, between 2 and 5. The most preferable pH value is 3. The reaction is carried out at a temperature lying between 20° to 60° C., and preferably at 40° C.

When the conditions required by proposed process are met, the redox potential can be set between 250 and 350 mV. The lignin content of wheat straw (ca. 18% lignin content) can, for example, be reduced to approximately 0% by this method. Fir wood pulp (ca. 28–30% lignin content) can also be broken down to similar end values. Surprisingly, such results can be achieved within 2 to 6 hours, and in many cases within 2 hours. Not taken into account in this case is the physical and/or chemical pretreatment which is especially important if wood or annual plants are to be processed.

The redox potential is set by varying the ratio of the different materials added to the reaction vessel. Appropriate measurement and regulation of the added oxidizing and reducing agents, salts and phenolic compounds, permit the maintenance of a specific redox potential throughout the reaction. The aim of such an adjustable redox system is that of preventing the lignin from repolymerizing.

This biological degradation principle has, for the first time, enabled the development of an economical process capable of removing lignin and involving a very short reaction time (2 to 6 hours) at physiological temperatures (40° C.), ambient pressure and a minimal addition of chemicals. The process is, moreover, not harmful to the environment. An additional advantage conferred by the present process is a high yield of cellulose or cellulosic material. For annual plants, the yield is approximately 80% and for wood, about 70%, based on the dry mass after pretreatment.

During the degradation and/or transformation reaction, the present process has a bleaching effect that permits the use of smaller quantities of bleaching agents. The proposed method is therefore capable of serving in the bleaching or post-bleaching procedure employed in conjunction with various processes. This bleaching characteristic also permits the proposed method to be used in biological bleaching processes and in the biological treatment of effluents produced by the cellulose industry. The present method may also be particularly useful wherever the discoloration or decontamination of effluents is required.

In the process supplementary bleaching may be carried out with conventional bleaching agents such as sodium hypochlorite, chlorine, ozone, $O_2$ and chlorine dioxide.

An additional advantage of the proposed process is its continuous mode of operation. The process can be managed very economically if spent enzymes are regenerated and afterwards returned to the reaction. This object is achieved by affinity chromatography. In this procedure, the enzyme is, upon termination of the reaction, passed through a separating column and then returned to the reaction process. The purification of the enzyme is carried out in the separating column by means of affinity chromatography. For this purpose, new specific ligand types have been developed, and are currently being used in the context of state-of-the-art enzyme technology. Such ligands are described in patent application PCT/EP 87/00214. In the present process, phenolic compounds can also be used. Similarly, protein-specific ligands, such as tannin, might also be suitable.

Another object of the proposed process is a plant suitable for removing and/or transforming lignin or its degradation products present in material containing lignocellulose. Such a plant comprises a reaction vessel; a device for adding oxidizing agents, reducing agents, salt or phenolic compounds; a vessel to receive converted raw materials, spent oxidizing agents, reducing agents, salts, phenolic compounds, enzymes and microorganisms; a device capable of separating dissolved and undissolved substances; a column suitable for affinity chromatography, wherein enzymes used in the lignin degradation reaction are regenerated; and a reflux for feeding the regenerated enzymes to the reaction vessel. Devices suitable for separating dissolved and undissolved substances can either be filters or concentrating apparatuses.

BRIEF DESCRIPTION OF THE INVENTION

The FIGURE shows the apparatus used for carrying not the process of the invention.

DETAILED DESCRIPTION OF THE INVENTION

There now follows a detailed description of the proposed plant as shown in the FIGURE. Microorganisms or enzymes are introduced into the reaction vessel 1, fitted with stirrer 10, through supply line 7. The microorganisms or enzymes can, if required, be immobilized inside the reaction vessel. Commonly used fillers and carriers can be used for immobilization. Oxidizing agents, reducing agents, salts or phenolic compounds can be added in small doses through supply and regulation means 4. The dosage can be regulated according to the prevailing redox potential. To this end, monitoring means including an electrode, schematically shown by reference numeral 9 in the diagram, can be installed, wherewith the redox potential is continuously monitored. By connecting this electrode to a suitable regulating system 4, it is possible to maintain the redox potential at a constant value throughout the reaction. The raw materials are also fed through supply line 7. Such raw materials can be lignin-containing substances of any type, particularly suitable exmaples of which are straw and wood that have undergone chemical and/or physical pretreatment. Lignin-containing spent liquor and affluent can similarly be treated in the proposed plant. Lignin is degraded in the reaction vessel with the aid of lignolytic enzymes or microorganisms. The enzymes employed are derived from the fungus Phanerochaete chrysosporium. Suitable microorganisms for the above reaction are mutants of cellulase and those free of hemicellulase. Mutants of Phanerochaete chrysosporium are particularly suitable in this regard. The converted raw material is, at the conclusion of the lignin degradation, discharged from the reaction vessel through discharge line 8 together with the spent chemicals, microorganisms and enzymes. The liquid is directed to a filter 3, where dissolved and undissolved substances are separated out. The enzymic solution is directed through a chromatographic column 2 that operates according to the princple of affinity chromatography. In this column, the enzymes are regenerated and then returned to the reaction process through line 5. The substances, once having been separated from the enzymes, are expelled through line 6. Ligands having an affinity for enzymes, of which a particulary suitable example are phenolic compounds, are used in the affinity chromatography procedure. Similarly, ligands having a specific affinity for proteins, especially tannin, can also be used.

The proposed process is explained in detail with the aid of the following example.

EXAMPLE 20 g dry (dried at 110° C.) and chopped straw of 10–20 mm length is treated with 400 ml 1 to 2% NaOH. Next, the chopped straw is filtered and washed with 1200 ml hot water. The filtered straw is placed in a Jokru mill to which 250 ml water is added and the contents ground at 150 rpm for 5–10 minutes. At this point, 1 g straw based on dry weight is placed in 90 ml water. While the mixture is being continuously stirred, the pH of the solution is adjusted to 3 by the addition of 0.2M HCl. Once the desired pH value has been reached, water is added to the solution, bringing it to 100 ml. Then $H_2O_2$ is added (60 ml of a solution containing 49 ml $H_2O$ +4 ml $H_2O_2$). An equimolar amount of ascorbic acid is next added. The reaction is initiated by the addition of enzymes derived from Phanerochaete chrysosporium (7000 U, 1U=uMol conversion of veratryl alcohol to veratryl aldehyde/1/min). This reaction was carried out at 40° C. After 2 hours, approximately 33% lignin was degraded.

I claim:

1. A process for degrading lignin in lignocellulosic raw material, comprising the steps of:

supplying an aqueous solution of lignocellulosic raw material containing lignin to a reaction vessel; adjusting the aqueous solution to an acidic pH; setting a redox potential at a range of about between 200 and 500 mV by adding redox chemical agents comprising at least one oxidizing agent, at least one reducing agent, at least one salt, at least one phenolic compound and at least one organic acid; adding to the reaction vessel a lignin degradation reaction agent selected from the group consisting of enzymes and microorganisms; and reacting the ingredients in the reaction vessel while stirring to degrade the lignin in the lignocellulosic material, continuously monitoring and maintaining the redox potential within said range by adding further amounts of said redox chemical agents, and maintaining substantially constant the pH and temperature of the reaction.

2. A process according to claim 1, wherein said range of the redox potential is between 250 and 350 mV.

3. A process according to claim 1, wherein said oxidizing agent is a member selected from the group consisting of $H_2O_2$, $O_2$ and ozone.

4. A process according to claim 1, wherein said reducing agent is a member selected from the group consisting of ascorbic acid, dithionite and sodium bisulfite.

5. A process according to claim 1, wherein said salt is a member selected from the group consisting of $MnSO_4$ and $FeCl_2$.

6. A process according to claim 1, wherein said phenolic compound is a veratryl alcohol.

7. A process according to claim 1, wherein said lignin degradation reaction agent is a lignolytic enzyme.

8. A process according to claim 1, wherein said lignin degradation reaction agent is at least one member selected from the group consisting of pectinase and hemicellulase.

9. A process according to claim 1, wherein said lignin degradation reaction agent is Phanerochaete chrysosporium.

10. A process according to claim 1, wherein said acidic pH is between 2 and 5.

11. A process according to claim 1, wherein said acidic pH is 3.

12. A process according to claim 1, wherein said temperature is between 20° and 60° C.

13. A process according to claim 1, wherein said temperature is 40° C.

14. A process according to claim 1, further comprising, after said reacting step, transferring the lignin degradation agent from the reaction vessel to an affinity-chromatographic separating column, purifying said lignin degradation agent in said affinity-chromatographic separating column, and returning the purified lignin degradation agent to the reaction vessel.

15. A process according to claim 14, wherein said affinity-chromatographic separating column contains enzyme-specific ligands.

16. A process according to claim 15, wherein said enzyme-specific ligands include phenolic compounds.

17. A process according to claim 14, wherein said affinity-chromatographic separating column contains protein-specific ligands.

18. A process according to claim 17, wherein said protein-specific ligands include tannin.

* * * * *